US011338603B2

(12) United States Patent
Langenscheidt et al.

(10) Patent No.: US 11,338,603 B2
(45) Date of Patent: May 24, 2022

(54) LIQUID INK-RECEIVING LAYERS OR FILMS FOR DIRECT INK JET PRINTING OR INK PRINTING

(71) Applicant: TRITRON GMBH, Battenberg-Dodenau (DE)

(72) Inventors: Andreas Langenscheidt, Marburg (DE); Jens Simon, Hatzfeld (DE)

(73) Assignee: TRITRON GMBH, Battenberg-Dodenau (DE)

( * ) Notice: Subject to any disclaimer, the term of this patent is extended or adjusted under 35 U.S.C. 154(b) by 0 days.

(21) Appl. No.: 16/854,354

(22) Filed: Apr. 21, 2020

(65) Prior Publication Data

US 2020/0247166 A1 Aug. 6, 2020

Related U.S. Application Data

(62) Division of application No. 15/100,437, filed as application No. PCT/DE2014/100414 on Nov. 25, 2014, now abandoned.

(30) Foreign Application Priority Data

Nov. 29, 2013 (DE) ..... 10 2013 113 282.0

(51) Int. Cl.

| | |
|---|---|
| ***B41M 5/50*** | (2006.01) |
| ***B41M 5/40*** | (2006.01) |
| ***B41M 5/52*** | (2006.01) |
| ***B41M 5/00*** | (2006.01) |
| ***B41M 7/00*** | (2006.01) |

(52) U.S. Cl.

CPC ..... *B41M 5/50* (2013.01); *B41M 5/0011* (2013.01); *B41M 5/0017* (2013.01); *B41M 5/5209* (2013.01); *B41M 5/5227* (2013.01); *B41M 5/5245* (2013.01); *B41M 7/00* (2013.01)

(58) Field of Classification Search

CPC ..... B41M 5/50; B41M 7/00; B41M 5/0011; B41M 5/0017; B41M 5/5245; B41M 5/5209; B41M 5/5227; B41M 5/0047; B41M 5/0041; B41M 1/26; B41J 2/01; B41J 2/17593; B41J 2/48

See application file for complete search history.

(56) References Cited

U.S. PATENT DOCUMENTS

| | | | | |
|---|---|---|---|---|
| 5,645,888 | A | 7/1997 | Titterington et al. | |
| 6,177,187 | B1 | 1/2001 | Niemoller et al. | |
| 7,520,601 | B2 * | 4/2009 | Claes | B41J 2/2114 347/102 |
| 7,758,922 | B2 | 7/2010 | Simon | |
| 8,133,539 | B2 * | 3/2012 | Oberski | B41J 11/002 427/287 |
| 8,632,174 | B2 * | 1/2014 | Noguchi | B41M 7/0081 347/100 |
| 9,278,515 | B2 * | 3/2016 | Sarkisian | B41M 5/0017 |
| 2003/0067527 | A1 | 4/2003 | Temple | |
| 2009/0104367 | A1 | 4/2009 | Simon | |
| 2012/0086762 | A1 | 4/2012 | Noguchi et al. | |
| 2012/0162337 | A1 | 6/2012 | Oberski et al. | |
| 2013/0076842 | A1 | 3/2013 | Sarkisian et al. | |
| 2014/0055520 | A1 * | 2/2014 | Inumaru | C09D 11/322 347/21 |
| 2016/0297223 | A1 | 10/2016 | Langenscheidt et al. | |

FOREIGN PATENT DOCUMENTS

| | | | |
|---|---|---|---|
| DE | 10204143 | A1 | 7/2003 |
| DE | 102006004341 | A1 | 8/2006 |
| EP | 0581135 | A1 | 2/1994 |
| EP | 1652686 | A1 | 5/2006 |
| EP | 1859953 | A2 | 11/2007 |
| EP | 2017086 | A1 | 1/2009 |
| EP | 2660066 | A1 | 11/2013 |
| WO | 9964249 | A1 | 12/1999 |

OTHER PUBLICATIONS

"Polyacrylic acid," Wikipedia, 3 pages, accessed Mar. 4, 2019, <https://en.wikipedia.org/wiki/Polyacrylic_acid>.

"Citric acid," Wikipedia, 8 pages, <https://en.wikipedia.org/wiki/Citric_acid>.

Product Description, CMR-413.W, Version: V-2016-001, CMR Coatings GmbH, 3 pages.

Technical Bulletin, CMR-413.W, Version: V-2016-001, CMR Coatings GmbH, 3 pages.

Technical Bulletin, CMR-613.W, Version: V-2016-001, CMR Coatings GmbH, 2 pages.

Product Description, CMR-111, Version: V-2016-001, CMR Coatings GmbH, 3 pages.

Technical Bulletin, CMR-111, Version: V-2016-001, CMR Coatings GmbH, 3 pages.

Technical Bulletin, CMR-610, Version: V-2016-001, CMR Coatings GmbH, 2 pages.

"Alkyd resin lacquer," Wikipedia, accessed Dec. 16, 2016, 4 pages.

International Search Report, PCT/DE2014/100414, dated Mar. 19, 2015, 3 pages.

Written Opinion, PCT/DE2014/100414, dated Mar. 19, 2015, 6 pages.

* cited by examiner

*Primary Examiner* — Jason S Uhlenhake

(74) *Attorney, Agent, or Firm* — Stinson LLP

(57) ABSTRACT

Liquid ink-receiving layers or films (receiving layers) for direct ink jet printing or ink printing, into which low-viscous liquid (highly fluid) printing media (printing inks) can be introduced according to said printing methods, and which solidify or are able to be solidified at a time subsequent to the ink insertion (retarded). The invention eliminates limitations on the usability of raw materials for ink jet printing or ink printing, especially of film-forming agents but also of pigments and other ingredients. Moreover, corresponding compositions and methods for ink jet printing or ink printing are proposed.

20 Claims, No Drawings

LIQUID INK-RECEIVING LAYERS OR FILMS FOR DIRECT INK JET PRINTING OR INK PRINTING

REFERENCE TO RELATED APPLICATIONS

This application is a divisional application based on and claiming priority to U.S. application Ser. No. 15/100,437 filed May 31, 2016, which is a U.S. national stage application of International Patent Application No. PCT/DE2014/100414, filed Nov. 25, 2014, and claims the benefit of priority of German Application No. 10 2013 113 282.0, filed Nov. 29, 2013, the entire disclosures of which are incorporated herein by reference.

FIELD OF THE INVENTION

In the first instance, the invention relates to a liquid ink-receiving layer according to claim 1. Further, the invention concerns liquid ink-receiving layers or films (receiving layers) for direct ink jet printing or ink printing as well as corresponding compositions, uses and methods.

In particular, the invention relates to liquid (flowable) ink-receiving layers or films (receiving layers) for direct ink jet printing or ink printing into which, according to these said printing procedures, low-viscous liquid (highly fluid) printing media (printing inks) can be introduced, and which solidify or are capable to be solidified spontaneously or when chemically induced or photochemically induced, at a time subsequent to printing (with a delay, and/or retarded), optionally also in a thermally accelerated manner.

The aforesaid can be associated with a chemically or physically induced spatial fixation of the colorants (dyes or pigments) which have been introduced into the initially equally flowable receiving layer together with the highly fluid printing inks.

BACKGROUND

Ink jet printing or ink printing refer to non-contact forms of digital printing without subcarrier and without printing mold wherein printing media (printing inks) are applied, having been divided into individual volume units (drops), in a time and site dependent manner. Ink jet printing refers to continuously operating systems (Continuous Ink Jet, CIJ), and ink printing refers to discontinuously operating systems (Drop on Demand, DoD) which can be thermally (Thermal Ink Jet, TIJ) or piezo-electrically (Piezo Ink Jet, PIJ) activated.

For ink jet or ink-color printing, printing inks of different colors are printed side by side within a grid, depending on the color ordering system. The achievable resolution of the print is determined by this grid (defined ink distribution), and on the other hand, also by the ink leveling (spreading, accumulation or mixing) of the applied printing inks (undefined ink distribution).

Ink distribution or ink accumulation may substantially impair the resolution which can be achieved in ink jet- or ink color printing.

Printing inks for ink jet printing or ink printing comprise film-forming components to form solid films or layers. The formation of solid films or layers becomes necessary if the print-substrate is not sufficiently permeable (porous or swellable) to receive applied non film-forming components. In such a case, the print-substrate may also be referred to as a low- or non-absorbent substrate.

Generally, raw materials used for ink jet printing or ink printing, and film-forming agents used therewith, have to show a sufficient chemical resistance. The corresponding printing inks must be low-viscous fluid (highly fluid or runny, respectively). The above-mentioned two requirements alone, in addition to further requirements, limit the selection of the raw materials and hence, in particular, the selection of usable film-forming agents which can be processed into printing inks for ink jet printing or ink printing.

Known printing inks for ink jet- or ink printing which solidify or are capable to be solidified, especially spontaneously or when chemically induced, but also when photochemically induced, at a time subsequent to printing (retarded), optionally also in a thermally accelerated manner, inter alia, have the disadvantage that due to the chemically reactive film-forming components comprised, no sufficient storage stability of the inks can be provided. Frequently, the inks already solidify in their package or within the print head, i.e. prior to the targeted application onto the substrate. Consequently, the availability of the printing ink at the print head decreases progressively, which can be recognized by a progressively deteriorating printing quality.

Accordingly, until now it has not been possible to provide actually desired printing inks for ink jet printing or ink printing, because preferred, in particular low-viscous, printing inks are not capable to be stably stored together with actually preferred film-forming components, which solidify or are capable to be solidified, especially spontaneously or when chemically induced, but also when photochemically induced, at a time subsequent to printing (retarded), optionally also in a thermally accelerated manner, or they are not available in sufficient amount during the printing process.

SUMMARY OF THE INVENTION

Therefore, the present invention is based on the task to ameliorate at least one of the above listed disadvantages and limitations.

The problem underlying the present invention is further to eliminate limitations on the usability of raw materials for ink jet printing or ink printing, in particular of film-forming agents, but also of pigments and other ingredients.

For solving at least one of the above-mentioned problems, a contribution is provided by a liquid ink-receiving layer according to the features of claim 1.

Advantageous embodiments and further developments of the liquid ink-receiving layer of the invention can be learned from the claims subordinate thereto.

Also, compositions for forming inventive liquid ink-receiving layers and the use of such compositions for forming inventive ink-receiving layers are proposed. Finally, methods for ink jet printing or ink printing are proposed.

DETAILED DESCRIPTION OF PREFERRED EMBODIMENTS

The invention opens the possibility to use raw materials in connection with the ink jet printing or ink printing, which otherwise could not be used or only used in a severely limited extent.

Ink-receiving layers according to the invention, in particular, can advantageously be provided on low or non-absorbent substrates. Thus, the invention is especially suitable for use in printing onto low or non-absorbent substrates.

Herein, the meaning of the terms ink-receiving layer and receiving layer, respectively, within the sense of the present invention always includes the terms ink receiving film and receiving film, respectively. In this, a receiving film within the meaning of the present invention is considered as a relatively thin receiving layer. Thus, instead of using the term (ink-) receiving layer, one may also use the term (ink-) receiving film, without departing from the present invention. Further, according to the understanding of the present invention, an ink-receiving layer also can optionally be referred to as receiving layer (and vice versa) without any alteration in meaning and, similarily, an ink-receiving film also can optionally be referred to as receiving film (and vice versa).

Herein, the understanding of the term printing ink within the meaning of the present invention, always includes the term printing media, even if, in a particular case, a printing medium could be used without colorants. However, since usually a printing ink finds use as a printing medium, the term printing ink shall be used in a comprehensive way for sake of clarity in describing the invention. Consequently, instead of the term printing ink, also the term printing medium could be used, without any deviation from the scope of the present invention thereby.

An ink shall be understood as a printing ink (print color) in the meaning of the present patent application.

Liquid Receiving Layer

The goal of the present invention consists in abolishing limitations on useable film-forming agents for non-contact ink jet printing or ink printing. For this purpose, film-forming agents are precedingly applied in the form of liquid (flowable) ink-receiving layers or films (receiving layers), independent from the ink jet printing or ink printing, into which subsequently applied (introduced) printing media (printing inks) can penetrate. Herewith, a separate storage and a separate application of print colors (e.g. inks), especially of low-viscous inks, and film-forming components is made possible. According to the invention, insufficient storage stability as well as untimely hardening of such low-viscous print colors (inks) can be avoided.

The limitations on usable film-forming agents can present themselves as physical or mechanical (resistance to smearing, abrasion resistance, elasticity), as chemical (resistance to acids and bases), as physico-chemical (water resistance, solvent resistance) or as photophysical (light fastness) durabilities or as the adhesion of the solid film to be formed, and/or can relate to requirements on the ingredients, such as environmental tolerability, toxicology, migration potential, odor, or taste.

Previously known absorbent layers are penetrable (porous or swellable) and not flowable (solid), and primarily serve to regulate the leveling of the printing inks introduced into these solid receiving layers. Porous layers are physically or mechanically of quite limited durability, and swellable layers are physico-chemically of quite limited durability.

Spatial Fixation

The low-viscous liquid (highly fluid) printing media (printing inks), which have been applied in volume-units onto a liquid (flowable) ink-receiving layer or a liquid ink-receiving film (receiving layer), show a leveling according to their flowability, initally depending on the flowability of the equally liquid receiving layer and depending on the evolved interfacial tensions. The leveling rate is determined by the flowability of the applied printing inks, by the flowability of the liquid receiving layer, and by interfacial tensions as film formation progresses.

The inventive liquid ink-receiving layers or films can comprise means which regulate the leveling of the printing inks introduced into the flowable receiving layer. In the context of the present invention it has turned out to be particularly advantageous to spatially fix (immobilize) the colorants (dyes or pigments) which, together with the highly fluid printing inks, have been introduced into the initially equally liquid receiving layer.

Spatial fixation of introduced colorants can refer to agglomerations of the colorant or surrounding ingredients or other ingredients which are triggered by chemical interactions with ingredients of the inventive liquid ink-receiving layer or the inventive liquid ink-receiving film. Agglomerations can be associated with reductions in solubilities.

Introduced colorants also can be spatially fixed by agglomerations of ingredients of the inventive liquid ink-receiving layer or the inventive liquid ink-receiving film which are triggered by chemical interactions with ingredients of the introduced highly fluid printing inks, and which result in a sufficiently rapid reduction of the flowability of the liquid receiving layer. Agglomerations can be associated with reductions in solubilities.

A sufficiently quickly reduced mobility of introduced colorants, due to thermally accelerated evaporation of the solvent, also results in their spatial fixation.

Film Formation

After the low-viscous liquid (highly fluid) printing media (printing inks), which had been applied in volume units onto an inventive liquid (flowable) ink-receiving layer or an inventive liquid ink-receiving film (receiving layer), optionally have been spatially fixed (immobilized) in accordance to the invention, the film should solidify (harden). The present invention allows superior film durability and optimum adhesion because it abolishes limitations on film-forming agents usable in printing media for ink jet printing or ink printing.

Film durabilities essentially are the result of the curing, the chemical functionality and the coloring components of a solid film that forms, and are directly dependent of its nature.

In general, the extent of the curing determines the physical and physico-chemical characteristics of a film, and the following applies: the higher the curing, the higher the resistance to smearing and abrasion, and the lesser the curing, the higher the solubility and the elasticity.

Chemical resistance essentially is the result of its functionality.

The photophysical durability, or light fastness, of a film can be significantly determined by the photophysical durability of the colorant. Typically, pigments offer the best light fastness.

Films or layers can be classified on the basis of the processes involved in their formation. Primarily, a distinction can be made between physical and chemical hardening.

Physical hardening refers to processes for forming solid films which are of pure physical nature, wherein the chemical nature of the utilized components remains unaffected. A distinction can be made between drying of non-coalescent components, drying by phase transition and drying with subsequent coalescence.

Coalescence refers to the film-creating agglomeration (and vice-versa).

The formation of the film due to drying of non-coalescent components is the classical film-forming process of printing inks. The film is formed after the evaporation of volatile components. Non-volatile and non-coalescent components are left behind which form the said film.

Less common is the formation of solid films by changing the aggregate state of liquid melts, such as the solidification of liquid waxes.

In the recent years, film formation by drying with subsequent coalescence has gained in importance for non-contact digital printing. In this case, the film forms after evaporating volatile components off the colloidal, coalescent ingredients. Today, such inks are frequently described as latex inks.

In the context of the chemical hardening a solid film is formed by curing or polymerization, respectively. The chemical curing can occur in a radiation-induced, chemically induced or catalyzed or even in a spontaneous manner.

Within the radiation-induced curing, a distinction can be made between electron-beam curing and ultraviolet curing. The chemically induced or catalyzed hardening can be triggered oxidatively by atmospheric oxygen or by acids or simply by water, just to mention a few options.

Prominent examples of spontaneous curing are 2-component systems. Currently, neither oxidative hardening nor 2-component systems play any important role in non-contact digital printing.

Processes of chemical hardening also can be thermally initiated or accelerated.

Transparency and Color

Liquid (flowable) ink-receiving layers or films (receiving layers) according to the invention may be more or less transparent, and more or less colorful.

Transparent and colorless liquid receiving layers allow for any penetration depths of applied, low-viscous liquid (highly fluid) printing media (printing inks). However, the representable color-space of translucent printing inks may be limited by the color of the substrate background.

Transparent and non-white colored liquid receiving layers limit the representable color-space of translucent printing inks also depending on the penetration depth.

Intransparent and white-colored liquid receiving layers result in a limitation of the representable color-space, if the highly fluid printing ink penetrates into the receiving layer.

In the context of the present invention it has proven to be particularly beneficial to use transparent and colorless liquid receiving layers on white substrates, and intransparent and white-colored liquid receiving layers on non-white substrates.

Coating Procedure

Liquid (flowable) ink-receiving layers or films (receiving layers) can be applied in non-atomizing coating procedures (dip coating, roller coating, pouring, flooding, analogous or digital printing with printing mold) or in spray-coating procedures (sputtering or spraying, compressed air spraying, airless and high pressure-sputtering, electrostatic spraying, digital printing without printing mold).

In the present invention, numerous further embodiments are conceivable which may be composed arbitrarily from combinations of any features disclosed herein. In this, particularly, also features of the advantageous embodiments of the invention specifically described hereinabove, are capable to be combined in any way to achieve further beneficial embodiments der invention.

EMBODIMENTS

In supplement and in addition, respectively, to the already discussed advantageous implementations and further developments, in the following, the invention will be described by additional embodiments which are preferred, but do not limit the invention to the described embodiments.

Embodiment 1

Liquid ink-receiving layers or films (receiving layers) for direct ink jet printing or ink printing, into which, according to these printing methods, low-viscous liquid (highly fluid) printing media (printing inks) can be introduced, and which solidify or are capable to be solidified at a time subsequent to the ink insertion (retarded).

Embodiment 2

Liquid ink-receiving layers or films according to embodiment 1, containing at least one initiator which, for the furtherance of a defined ink distribution, induces a spatial fixation (immobilization) of the colorants (dyestuffs or pigments) which have been introduced together with the highly fluid printing inks into the initially equally liquid receiving layer.

Embodiment 3

Liquid ink-receiving layers or films according to embodiment 2, in which the initiator induces a sufficiently rapid reduction in flowability of the applied printing ink.

Embodiment 4

Liquid ink-receiving layers or films according to embodiment 3 which result in a partial polymerization of the applied printing ink.

Embodiment 5

Liquid ink-receiving layers or films according to embodiment 3, which result in a complete polymerization of the applied printing ink.

Embodiment 6

Liquid ink-receiving layers or films according to embodiment 2, in which the initiator induces an agglomeration of ingredients of the applied printing ink.

Embodiment 7

Liquid ink-receiving layers or films according to embodiment 6, in the context of which an agglomeration is induced by the ingredients surrounding the colorants (dyes or pigments).

Embodiment 8

Liquid ink-receiving layers or films according to embodiment 6, in the context of which an agglomeration of the colorants is induced.

Embodiment 9

Liquid ink-receiving layers or films according to any one or more of the embodiments 6 to 8, in the context of which reduced solubilities result in agglomerations.

Embodiment 10

Liquid ink-receiving layers or films according to any one or more of the embodiments 2 to 9, wherein the initiator is a polyanion.

Embodiment 11

Liquid ink-receiving layers or films according to any one or more of the embodiments 2 to 9, wherein the initiator is a polycation.

Embodiment 12

Liquid ink-receiving layers or films according to any one or more of the embodiments 2 to 9, wherein the initiator is a monomeric, oligomeric, or polymeric acid.

Embodiment 13

Liquid ink-receiving layers or films according to embodiment 12, wherein the acid is a mono- or polyfunctional carboxylic acid.

Embodiment 14

Liquid ink-receiving layers or films according to any one or more of the embodiments 2 to 9, wherein the initiator is a monomeric, oligomeric, or polymeric base.

Embodiment 15

Liquid ink-receiving layers or films according to any one or more of the embodiments 2 to 9, wherein the initiator is a polyvalent salt.

Embodiment 16

Liquid ink-receiving layers or films according to embodiment 1, which, in furtherance of a defined ink distribution, ensure a spatial fixation (immobilization) of the colorants (dyes or pigments) which have been introduced together with the highly fluid printing inks into the initially equally liquid receiving layer.

Embodiment 17

Liquid ink-receiving layers or films according to embodiment 16, the flowability of which decreases sufficiently rapid, triggered by at least one ingredient of the applied printing ink, in furtherance of a defined ink distribution.

Embodiment 18

Liquid ink-receiving layers or films according to embodiment 17, which polymerize partially, triggered by at least one ingredient of the applied printing ink.

Embodiment 19

Liquid ink-receiving layers or films according to embodiment 17, which polymerize totally, triggered by at least one ingredient of the applied printing ink.

Embodiment 20

Liquid ink-receiving layers or films according to embodiment 16, which include at least one substance which, triggered by at least one ingredient of the applied printing ink, agglomerates in furtherance of a defined ink distribution.

Embodiment 21

Liquid ink-receiving layers or films according to embodiment 20, in the context of which reduced solubilities result in agglomerations.

Embodiment 22

Liquid ink-receiving layers or films according to any one or more of the embodiments 1 to 21, which solidify or are capable to be solidified in a thermally accelerated manner.

Embodiment 23

Liquid ink-receiving layers or films according to any one or more of the embodiments 1 to 22, which solidify through drying with subsequent coalescence.

Embodiment 24

Liquid ink-receiving layers or films according to embodiment 23 which are dispersion paints.

Embodiment 25

Liquid ink-receiving layers or films according to any one or more of the embodiments 1 to 22 which solidify spontaneously.

Embodiment 26

Liquid ink-receiving layers or films according to embodiment 25, which are two- or multi-component systems.

Embodiment 27

Liquid ink-receiving layers or films according to any one or more of the embodiments 1 to 22 which solidify or are capable to be solidified in a chemically induced manner.

Embodiment 28

Liquid ink-receiving layers or films according to embodiment 27 which cure chemically, triggered by atmospheric oxygen.

Embodiment 29

Liquid ink-receiving layers or films according to embodiment 28 which are air-drying alkyd resin systems.

Embodiment 30

Liquid ink-receiving layers or films according to embodiment 27, which cure chemically, triggered by acids.

Embodiment 31

Liquid ink-receiving layers or films according to embodiment 30, which are acid curing single-component systems.

Embodiment 32

Liquid ink-receiving layers or films according to embodiment 27, which cure chemically, triggered by water.

Embodiment 33

Liquid ink-receiving layers or films according to embodiment 32, which are sol-gel systems.

Embodiment 34

Liquid ink-receiving layers or films according to any one or more of the embodiments 1 to 22, which can be solidified in a photochemically induced manner.

Embodiment 35

Liquid ink-receiving layers or films according to embodiment 34, which cure, triggered by electron beams.

Embodiment 36

Liquid ink-receiving layers or films according to embodiment 34, which cure, triggered by UV radiation.

Embodiment 37

Liquid ink-receiving layers or films according to embodiment 34, which cure, triggered by visible light.

Embodiment 38

Liquid ink-receiving layers or films according to any one or more of the embodiments 1 to 37, which are transparent and colorless.

Embodiment 39

Liquid ink-receiving layers or films according to embodiment 38, wherein the ink-receiving layer is a clearcoat or a clearcoat system.

Embodiment 40

Liquid ink-receiving layers or films according to any one or more of the embodiments 1 to 37, which are intransparent and white-colored.

Embodiment 41

Liquid ink-receiving layers or films according to any one or more of the embodiments 1 to 37, which contain metallic pigments.

Embodiment 42

Liquid ink-receiving layers or films according to any one or more of the embodiments 1 to 37, which contain effect-pigments.

Embodiment 43

Liquid ink-receiving layers or films according to embodiment 42, in which the effect-pigments are metallic pigments.

Embodiment 44

Liquid ink-receiving layers or films according to embodiment 42, in which the effect-pigments are pearlescent pigments or interference pigments.

Embodiment 45

Liquid ink-receiving layers or films according to any one or more of the embodiments 1 to 44, which contain matting agents.

Embodiment 46

Liquid ink-receiving layers or films according to embodiment 45, in which the matting agents are pigments.

Embodiment 47

Liquid ink-receiving layers or films according to any one or more of the embodiments 1 to 46, which after solidification are poor in migration.

Embodiment 48

Liquid ink-receiving layers or films according to embodiment 47, which exhibit barrier properties after the solidification.

Embodiment 49

Liquid ink-receiving layers or films according to any one or more of the embodiments 1 to 48, which are applied in non-atomizing coating procedures (dip coat, roller coating, pouring, flooding, analogous or digital printing with printing mold).

Embodiment 50

Liquid ink-receiving layers or films according to any one or more of the embodiments 1 to 48, which are applied in spray-coating procedures (sputtering or spraying, compressed air spraying, airless and high pressure-sputtering, electrostatic spraying, digital printing without printing mold).

Embodiment A

Method for ink jet printing or ink printing, wherein said method comprises the steps of:

application of a liquid (flowable) ink-receiving layer or film (a receiving layer), and especially according to any one or more of the preceding embodiments, onto a substrate, application, by direct ink jet or ink printing, of liquid, in particular highly fluid, printing media, especially printing inks, onto or into the liquid ink-receiving layer or onto or into the liquid ink-receiving film, solidification, especially hardening, of the ink-receiving layer or the ink-receiving film.

Embodiment B

Method according to embodiment A, characterized in that prior to the solidification of the ink-receiving layer or the ink-receiving film, a reduction of the flowability, and particularly an immobilization or fixation, of the colorants introduced with the printing media occurs.

Embodiment C1

Composition of a liquid ink-receiving layer or film according to any one or more of the embodiments 1 to 48.

Embodiment C

Composition for forming liquid ink-receiving layers or films according to any one or more of the embodiments 1 to 48.

Embodiment D

Use of a composition according to embodiment C for forming liquid ink-receiving layers or films according to any one or more of the embodiments 1 to 48.

Embodiment E

Use of a composition for forming liquid ink-receiving layers or films according to any one or more of the embodiments 1 to 48.

Although the present invention is described in detail by the presented advantageous designs and further developments of the above-mentioned embodiments as well as the implementation examples described below, it is obvious for one skilled in the art that variations or modifications are possible by different combination of individual features or omitting individual features without departing from the protective scope of the accompanying claims. In particular, the protective scope of the claims shall not be limited to the described advantageous designs, further developments and embodiments.

EXAMPLES

Examples for carrying out the invention which, however, do not limit the invention to the examples described, are shown in the context of the following discussion of exemplary inventive receiving layers as well as of their use. The tabulated compositions of these exemplary inventive receiving layers and the layers themselves, at the same time, represent—additionally or supplementary to the subject matter of the subordinate claims and all subject matters discussed above—particularly preferred embodiments of the invention.

Liquid (flowable) ink-receiving layers or films (receiving layers) can be low-viscous or highly fluid (<8,000 mPa·s), moderately viscous or viscous (8,000 to 20,000 mPa·s) or highly-viscous or viscid (>20,000 mPa·s).

It has been shown that low-viscous liquid (highly fluid) printing media (printing inks) cannot be introduced into low-viscous receiving layers in absence of spatial fixation, without the printing ink unduly running, at least not into such having viscosities up to 3,000 mPa·s.

All examples shown in this section relate to low-viscous receiving layers having viscosities up to 500 mPa·s. The receiving layers were imprinted with images within 30 min or within the workability period of the used materials (pot life), respectively, using a high-resolution model EPSON Stylus® R2000 printer. In doing so, printing inks have been applied in an imaging manner known per-se onto the previously provided receiving layer. The printed image obtained in this way, in each case, was appropriate for evaluating the optical qualities.

Flowable receiving-layers without separately induced spatial fixation: All examples shown in this section were carried out using low-viscous ink-printing inks of the applicant Tritron GmbH, 35088 Battenberg, Germany, which did not contain any film-forming agents, and contained exclusively pigments as colorants, and, therefore, are not suited for the direct imprinting onto poorly or non-absorbent surfaces. The pigments are stabilized, such that they are able to be flocculated, triggered by a suitable initiator according to European Patent 1,851,063, and therefore are able to be spatially fixed in inventive liquid ink-receiving films. The varicolored ink-printing colors employed, can be purchased under the version designation DOD-WOW-EP-CMYK-001-03.

Spontaneously Solidifying—2-Component Systems: 2-component systems consist of at least one curable film-forming agent (basis) and one film-forming agent which triggers the curing (hardener). Such systems are not suitable for use as printing inks for ink jet printing or ink printing because they solidify spontaneously. However, 2-component-systems may serve for the preparation of receiving layers according to the invention. For this purpose, two systems of CMR® Coatings GmbH, Wilhelmstrasse 8, 32602 Vlotho, Germany, have been investigated: CMR-413.W in conjunction with CMR-613.W, as well as CMR-111 in conjunction with CMR-610. CMR-413.W and CMR-111 are aqueous 2-component clearcoats, consisting of polyurethane (aqueous polyurethane dispersion). CMR-613.W designates an isocyanate hardener solution for aqueous systems, and CMR-610 is a 100% polyfunctional aziridine crosslinker for aqueous and solvent-based systems. CMR-413.W in conjunction with CMR-613.W has a dynamic initial viscosity of 13.9 mPa·s, and CMR-111 in conjunction with CMR-610 has a dynamic initial viscosity of 97.3 mPa·s.

A separate regulation of the leveling of the printing inks introduced into these flowable receiving layers was not necessary. In each case, the application was performed using a K-CONTROL-COATER® doctor knife-coater of ERICHSEN GmbH & Co., 58675 HEMER, Germany, equipped with a 24 μm doctor rod.

After complete solidification, in each case, an properly scratch- and properly smear-proof film having uniform gloss, properly adhering on PVC, was formed. The imprints applicated onto the above-mentioned receiving layers are characterized by homogenous color areas, and accurate edge sharpness. CMR-111 in conjunction with CMR-610 forms an especially elastic film.

Physico-Chemically Solidifying—Sol-Gel Process:

The sol-gel process refers to methods for the production of non-metallic hybrid-polymeric materials from colloidal dispersions. Such dispersions are of only limited suitability as printing inks for ink jet printing or ink printing, since they are not permanently stable, but they can serve for the preparation of inventive receiving layers. For this purpose, two systems, WFP-LTX-Clear-011 and WFP-LTX-Clear-012, have been investigated, the compositions of which are listed in table 1 and table 2.

Therein, all numerical values in the tables are to be interpreted as % per weight (wt. %), and refer to the total weight of the receiving layer.

TABLE 1

Composition of the receiving layer WFP-LTX-Clear-011

| Ingredient | Amount [wt. %] |
|---|---|
| Byk 345 | 0.50 |
| Proxel GXL | 0.10 |
| Water | 28.60 |
| 2-Pyrrolidone | 10.00 |
| Surfynol 420 | 0.50 |
| Dipropylene glycol monomethyl ether | 10.00 |
| Lubaprint 205 | 5.00 |
| Joncryl FLX 5100 | 40.00 |
| 2-Dimethylaminoethanol | 0.30 |
| Xiameter OFS-6020 | 5.00 |

TABLE 2

| Composition of the receiving layer WFP-LTX-Clear-012 | |
|---|---|
| Ingredient | Amount [wt. %] |
| Byk 345 | 0.50 |
| Proxel GXL | 0.10 |
| Water | 23.60 |
| 2-Pyrrolidone | 10.00 |
| Surfynol 420 | 0.50 |
| Dipropylene glycol monomethyl ether | 10.00 |
| Lubaprint 205 | 5.00 |
| Joncryl FLX 5100 | 30.00 |
| 2-Dimethylaminoethanol | 0.30 |
| AQUATIX 8421 | 15.00 |
| Xiameter OFS-6020 | 5.00 |

BYK-345® is a silicone surfactant of the BYK® company for aqueous varnishes as well as for printing inks and overprint varnishes. Proxel® GXL is a wide spectrum biocide of Arch Chemicals® company, and contains water, dipropylene glycole and 1,2-benzisothiazoline-3-one. Surfynol® 420 is an ethoxylated wetting agent and a molecular defoamer by Air Products® company. Lubaprint® 205 is an aqueous PE-wax dispersion by the company MUnzing®, 78628 Rottweil, Germany. Joncryl® FLX 5100 is a RC (Rheology Controlled)-acrylic emulsion of the BASF® company. AQUATIX® 8421 is a rheology-modifying wax emulsion of the BYK® company on the basis of an EVA-copolymer wax. Xiameter® OFS-6020 is a liquid alkoxysilane produced by DOW® company.

WFP-LTX-Clear-011 has a dynamic initial viscosity of 12.3 mPa·s, and WFP-LTX-Clear-012 has a dynamic initial viscosity of 30.4 mPa·s.

Any regulation of the leveling of the printing inks introduced into the flowable receiving layers acc. table 1 and table 2 was not necessary. In each case, the application was performed using a K-CONTROL-COATER® doctor knife-coater of ERICHSEN GmbH & Co. KG, 58675 HEMER, Germany, equipped with a 24 μm doctor rod.

After complete solidification, in each case, a film having uniform gloss, properly adhering on PVC, has been formed. The imprints applicated onto the above-mentioned receiving layers are characterized by homogenous color areas, and accurate edge sharpness.

Flowable Receiving Layers with Separately Induced Spatial Fixation

Chemically Solidifying Induced by Radiation—Cationic UV Curing

In contrast to radically curing printing inks, cationically curing printing inks are only of limited suitability for ink jet printing or ink printing, because polymer-forming reactions, once triggered, can also proceed in the absence of additional radiation in the dark. One the one hand, this property of cationically curing printing inks endangers the operational reliability of corresponding ink jet- or ink printing systems. One the other hand, cationically curing printing inks are not subjected to oxygen inhibition, and offer a comparatively lower migration potential.

For the manufacture of inventive receiving layers, again, two systems were evaluated: NoriCure® UV-L 3 of Proell KG, 91781 Weissenburg, Germany, and Fototex® 3D of MacDermid Autotype Ltd., Grove Road, Wantage, OX12 7BZ, United Kingdom. NoriCure® UV-L 3 has a viscosity of 455 mPa·s, and Fototex® 3D has a viscosity of 275 mPa·s.

Both examples were carried out using low-viscous ink printing colors of the applicant, Tritron GmbH, 35088 Battenberg, Germany, version designation DOD-LTX-EPS-01-006. These ink-printing colors are aqueous polyurethane dispersions, are basically suited for the imprint onto poorly or non-absorbent surfaces, and are able to be spatially fixed according to the European Patent 1,851,063 in inventive liquid ink-receiving films.

Leveling of the printing colors introduced into these flowable receiving layers was regulated by the addition of aconitic acid. The application was performed by screen printing.

After the final UV-curing, in each case, an extraordinarily scratch- and extraordinarily smear-proof film, properly adhering on PVC, has been formed. The imprints applicated onto the above-mentioned receiving layers is characterized by homogenous color areas, and accurate edge sharpness. Fototex 3D forms a film suitable for deep-drawing.

The invention claimed is:

1. Method for ink jet printing or ink printing, wherein the method comprises the following steps:

application of a liquid ink-receiving layer for direct ink jet printing or ink printing, into which liquid printing inks can be introduced and which solidifies or is able to be solidified at a time subsequent to the ink insertion, onto a substrate, wherein the ink-receiving layer comprises film-forming agents, and wherein the ink-receiving layer solidifies or is able to be solidified by chemically induced curing, by catalyzed curing, by thermally initiated curing, by spontaneous curing, or by physico-chemical sol-gel solidification;

application, by direct ink jet printing or ink printing, of liquid printing inks onto or into the liquid ink-receiving layer, solidification of the ink-receiving layer.

2. Method according to claim 1, wherein, prior to the solidification of the ink-receiving layer, an immobilization or fixation, of the colorants introduced with the printing media occurs.

3. Method according to claim 1, wherein the ink-receiving layer applied onto the substrate provides a spatial fixation (immobilization) of colorants, comprising dyes or pigments, introduced together with liquid printing inks into the liquid receiving layer.

4. Method according to claim 1, wherein the flowability of the ink-receiving layer applied onto the substrate, triggered by at least one ingredient of an introduced printing ink, is able to be reduced in a sufficiently rapid manner.

5. Method according to claim 1, wherein the ink-receiving layer applied onto the substrate, triggered by at least one ingredient of an introduced printing ink, is partially or completely polymerizable.

6. Method according to claim 1, wherein the ink-receiving layer applied onto the substrate comprises at least one ingredient which agglomerates, triggered by at least one ingredient of an applied printing ink.

7. Method according to claim 6, wherein reduced solubility results in an agglomerating of ingredients.

8. Method according to claim 1, wherein the ink-receiving layer applied onto the substrate is able to be solidified in a thermally accelerated manner.

9. Method according to claim 1, wherein the ink-receiving layer applied onto the substrate is a two- or multi-component system.

10. Method according to claim 1, wherein the ink-receiving layer applied onto the substrate is able to be solidified by chemically induced curing, and the chemically induced curing is triggered by atmospheric oxygen.

11. Method according to claim 1, wherein the ink-receiving layer applied onto the substrate is an air-drying alkyd resin system.

12. Method according to claim 1, wherein the ink-receiving layer applied onto the substrate is able to be solidified by chemically induced curing, triggered by acids.

13. Method according to claim 1, wherein the ink-receiving layer applied onto the substrate is an acid curing single-component system.

14. Method according to claim 1, wherein the ink-receiving layer applied onto the substrate is able to be solidified by chemically induced curing, triggered by water.

15. Method according to claim 1, characterized in that the ink-receiving layer applied onto the substrate is a sol-gel system.

16. Method according to claim 1, wherein the ink-receiving layer applied onto the substrate is transparent and colorless.

17. Method according to claim 1, wherein the ink-receiving layer applied onto the substrate is intransparent and white-colored.

18. Method according to claim 1, wherein the ink-receiving layer applied onto the substrate is a clearcoat or a clearcoat system.

19. Method according to claim 1, wherein the ink-receiving layer is applied onto the substrate by a non-atomizing coating procedure selected from the group consisting of dip coating, roller coating, pouring, flooding, analog and digital printing with printing mold.

20. Method according to claim 1, wherein the ink-receiving layer is applied onto the substrate by a spray-coating procedure selected from the group consisting of sputtering, spraying, compressed-air spraying, airless- or high pressure-sputtering, electrostatic spraying, and digital printing without printing mold.

* * * * *